United States Patent [19]

Kirstenpfad et al.

[11] 4,023,610

[45] May 17, 1977

[54] STRAND SUPPORT METHOD

[75] Inventors: Fritz Kirstenpfad, Bad Harzburg; Friedrich Konning, Wittlaer, both of Germany

[73] Assignee: Demag, A.G., Germany

[22] Filed: Oct. 6, 1975

[21] Appl. No.: 620,223

[30] Foreign Application Priority Data

Oct. 7, 1974 Germany ..... 2447800

[52] U.S. Cl. ..... 164/4; 164/82

[51] Int. Cl.[2] ..... B22D 11/12

[58] Field of Search ..... 164/282, 82, 4

[56] References Cited

FOREIGN PATENTS OR APPLICATIONS 1,118,451 7/1968 United Kingdom ..... 164/282

*Primary Examiner*—Robert D. Baldwin

*Attorney, Agent, or Firm*—Mandeville and Schweitzer

[57] ABSTRACT

Methods and apparatus are provided for determining the longitudinal and transverse distance required between points of support for a freshly cast strand of steel, so that the hardened outer shell is maintained intact until such time as the thermal compressive stress on the shell exceeds the tensile stress caused by the ferrostatic pressure of the liquid core. The methods and apparatus herein reduce to a minimum, not only the distance between the points of support and the number of points, but also the extent of support required between the point of initial support and the point where support is no longer required.

2 Claims, 2 Drawing Figures

STRAND SUPPORT METHOD

BACKGROUND OF THE INVENTION

It is known that during the casting of a strand, the strand produced in a steel strand casting installation must be braced or supported because of ferrostatic pressure from the liquid core in the upper part of the strand in order to avoid bulging and tearing of the partially solidified strand shell. Such bracing or support may be provided by means of rolls on an axle or shaft, or by means of plates. The latter have not been employed too successfully because they require channels for cooling water, which become clogged at times. Vapor formed in these clogged channels creates pressure which, in turn, may cause explosions.

If rolls are used to support the partially solidified strand, they may either be full width rolls extending transversely of the strand path and as wide as the strand itself or they may be divided into several rolls of narrower width. Full width rolls generally must be of diameters which increase as a function of increased distances from the casting level, due to the substantial bending stresses imposed by the strand. Thus, minimum axle distances between rolls, and thus unsupported lengths of the strand are largely predetermined by roll diameters. The advantages of full width rolls is that their bearings are laterally spaced at each side of the hot strand path, and are therefore not subjected to great thermal stress, but there are significant disadvantages resulting from the large sizes of these rolls.

If unsupported spans of the strand are to be kept as small as possible, it is necessary to use several smaller rolls dividing the support of the strand over the width thereof. Depending on the division of the rolls over the strand width, one or several step bearings for the shaft or axle are required. These bearings are very close to the hot strand, and must, therefore, be given special protection. In order to increase the distance from the strand and still maintain small unsupported spans, it has been suggested to use discs in the place of rolls, with the discs having larger diameters than the usual roll diameters. The discs of two longitudinally spaced adjacent shafts or axles would then intermesh (see Austrian Pat. No. 262,528; German Disclosure No. 1,952,633). This latter construction has the smallest practicable unsupported spans of hot strand, and consequently many points for support and, to a large extent, protection from strand breakage.

It has also been suggested to confine the entire ferrostatic pressure of the liquid core by means of a special design of the strand cross section itself, and to entirely eliminate any support. The strand is designed to be self-supporting by forming the sides of the strand in a concave manner. Theoretically, this results in vault-like side walls capable of containing the liquid core. By eliminating the need for external support, water cooling can be applied to the strand, facilitating a more intensive cooling which shortens the length of the liquid core. This, in turn, provides for a decrease in the dimensions of the casting equipment. Furthermore, the resistance or drag caused by the supporting rolls during extraction of the strand from the equipment is reduced, so that the weight of the strand itself is theoretically sufficient to transport the strand within the equipment. The relatively small lateral support pressures resulting from the concave design of the strand side walls are contained by lateral supporting rolls (German Paper No. 2,144,082). This construction has not proved entirely satisfactory, however, because the concave shape of the strand side walls alone does not adequately insure against the possibility of the liquid core breaking through the strand shell. It has been further suggested to provide, in addition to the concave shape, a lattice-like support of undefined length starting under the chill mold (German Disclosure No. 2,264,454 and 2,206,606). This support is constructed in a fashion that does not affect the intensive water cooling, so that the strand shell may quickly reach sufficient tensile strength for transport by the driving rolls in the processing line.

It has now been found, mathematically, that the concave shape of the strand side walls has little effect upon the stability of the strand cross section. This is due to the fact that, with high strand temperature and the resulting plasticity of the material, no notable supporting effect can be achieved. The only controlling factor is the thermal stress in the strand shell. This thermal stress depends on the cooling of the strand shell which, when splashing on cooling water, is limited by the familiar Leidenfrost phenomenon.

STATEMENT OF THE INVENTION

The present invention is based on the realization that a strand of rectangular cross section can be cast without support and without concave side walls, as long as the thermal compressive stress in the shell exceeds the tensile stress caused by the ferrostatic pressure from the liquid core. This form of stabilization takes into account the resistance of the shell to deformation caused by support contact, which is directly related to the strand shell temperature, as well. In the area immediately adjacent the mold, particularly in the case of thick strands, the required strength of the strand shell has not been reached as yet, regardless of whether the side walls of the strand are straight or concave. In this area, supports must still be employed. It is the object of the invention to provide criteria for the design of a support required for the casting of strand regardless of size, whereby sufficient protection against breakthroughs of the liquid core is maintained, yet the least possible number of supporting rolls is used.

To solve the problem of providing a support structure of optimum effectiveness, particularly for steel casting installations, the invention proposes a supporting device, with divided rolls arranged at spaced intervals to support the strand leaving the mold with a hardening shell and a still-liquid core, where roll arrangement and spacing is so determined that, in longitudinal and/or transverse directions of the strand, the maximum unsupported spans W for the strand are found by the following formula:

$$W = (42 + 8\ L/Vg)$$

wherein L represents the distance measured in meters from the casting level in the mold to a given point of support, and $Vg$ represents the casting velocity measured in meters/minute. By reducing the number of the supporting rolls to the minimum requirement at any point in the support, not only the cost of the casting equipment is lowered, but a better accessibility for the cooling water is achieved at the same time. This, in turn, makes it feasible to obtain a more uniform cooling effect, over a larger strand surface, thus permitting a reduction in equipment dimensions.

The method according to the invention for supporting a freshly cast steel strand to maintain the integrity of the hardened shell thereof against rupture caused by ferrostatic pressure created by the still molten core may be characterized by the steps of:

a. casting the steel strand;
b. measuring the distance between the level of metal in the casting mold and the initial point of support;
c. measuring the casting velocity of the strand; and
d. providing a multiple point contact support for the freshly cast strand, with the distance W in centimeters between each point of contact longitudinally and transversely of the moving strand being determined by the formula $$W = 42 + 8\ L/Vg$$

wherein $L$ is the distance in meters from step (b) and Vg is the velocity from step (c) in meters per minute.

As further illustrative of the invention, attention is drawn to the following drawings and detailed description of the invention, in which various representative calculations are made in accordance with the invention for developing the proper support dimensions depending upon the actual conditions involved in molding a particular strand.

IN THE DRAWINGS:

FIG. 1 is a graphic illustration of several calculations prepared in accordance with the invention; and FIG. 2 is a diagrammatic illustration of a specific strand support outline using disc-shaped rolls.

DETAILED DESCRIPTION OF THE INVENTION

Figure 1:
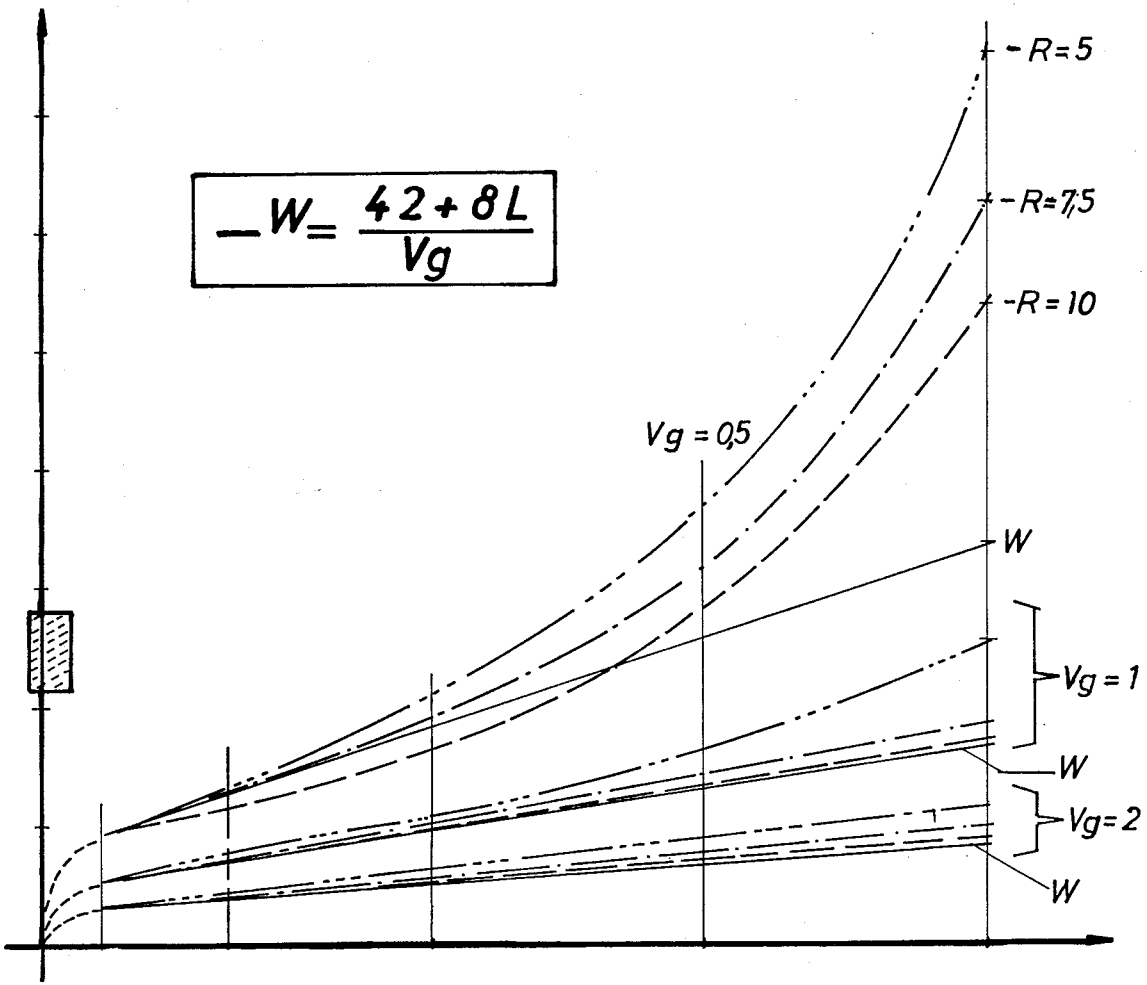

In FIG. 1, the results of such detailed calculations are represented graphically by broken lines, for various strand radii R and strand velocities $V_g$. The required support may, however, be approximated and at the same time a simplification essential for practical use is achieved, if maximum unsupported distance is calculated by the following formula:

$$W = (42 + 8\ L/Vg)$$

in which the value of L is in meters, $V_g$ in meters per minute, and W in centimeters. The formula is not applicable when L is less than one meter. Thus, up to about one meter from the casting level (or with the usual mold, up to 0.5 meter below the lower edge of the mold) the strand should be supported as tightly as feasible consistent with thorough cooling of the strand surface.

In the graph of FIG. 1, the approximated values of W, for various strand velocities ($V_g$=0.5, 1.0, 2.0), is shown by the three solid lines designated "W" at the right. It will be noted that, in general, the lines based on the approximation formula lie slightly below the curves based on detailed calculations, providing a conservatively safe approximation.

EXAMPLE 1

Figure 2:
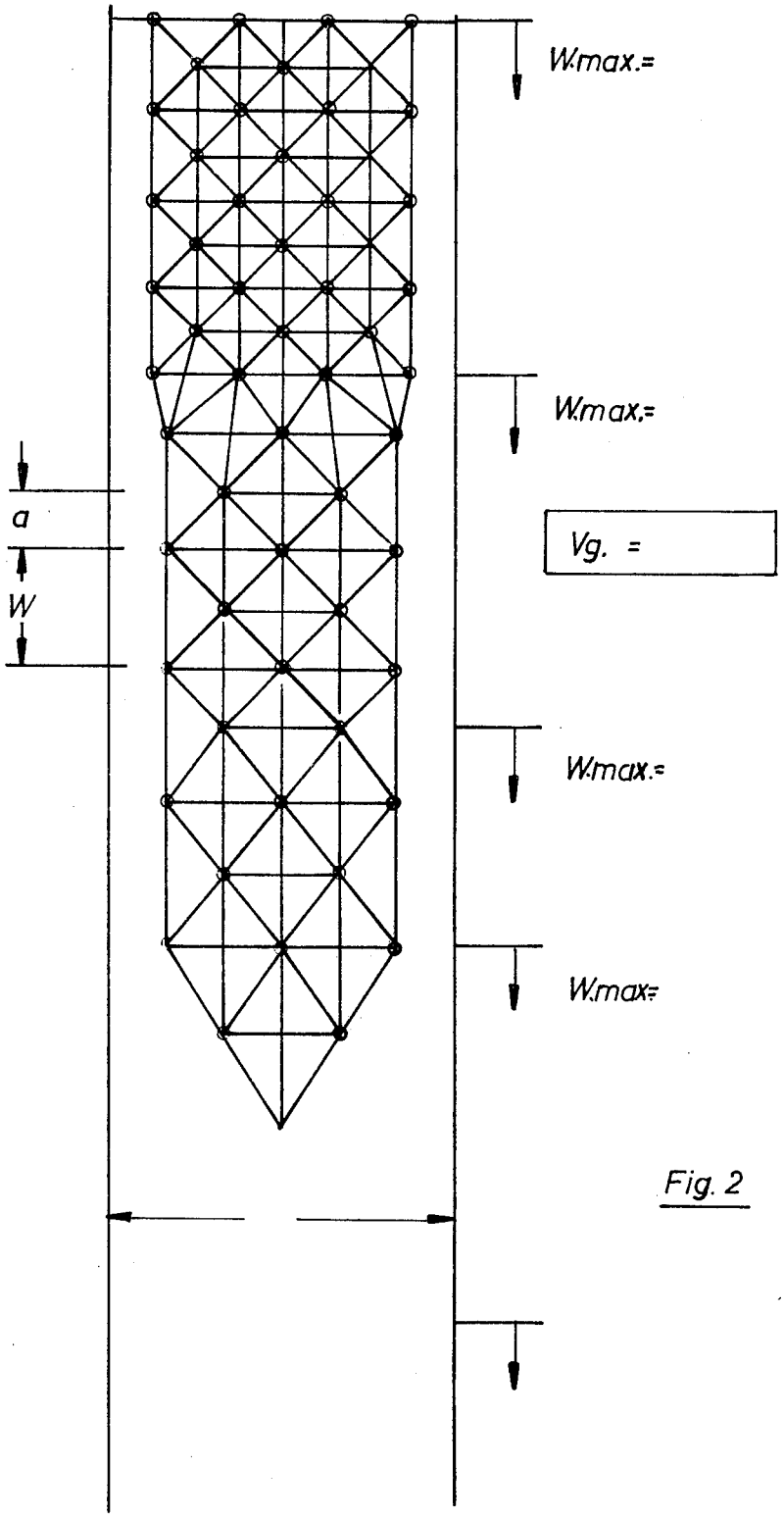

For support of a cast strand by means of disc-shaped rolls in an alternating or lattice-like arrangement, the axle to axle distance (a) is approximately equal to W/2, and the disc diameter D, is approximately equal to $W - d$, where "$d$" stands for axle diameter. For $V_g = 1 m/min$ and strand width $B = 2m$, the arrangememt as shown in FIG. 2 would apply for a lattice configuration of disc-shaped supporting rolls. In the schematic illustration, one disc touches the strand in each spot marked by a dot.

When figuring the disc width, the depth impression the disc makes into the strand must be taken into consideration, i.e. with L increasing, the requirement for supporting discs decreases. However, the more plastic the material remains, the wider the discs must be. Preferably, the width of the discs will be dimensioned to provide no more than a maximum indentation for each disc of 0.2 mm.

EXAMPLE 2

To support a strand of the width $B = 8$ cm, cast at a velocity of $V_g = 0.5$ m/min, the optimum supporting width at distance $L = 1$ m below the casting level, according to the approximation formula, is $$W = (42 + (8 \times 1)/0.5) = 100 \text{ cm}$$

According to this example 2, the strand starting at 1 m from the casting level, no longer requires support, since the maximum unsupported distance exceeds the width of the strand.

While the methods herein described form preferred embodiments of the invention, the invention is not limited to those specific methods, and changes can be made therein without departing from the scope of the invention, which is defined in the appended claims.

We claim:

1. In a method for supporting a freshly cast steel strand to maintain the integrity of the hardened shell thereof against rupture caused by ferrostatic pressure created by the still molten core, characterized by the steps of a. casting the steel strand;
b. measuring the distance between the level of metal in the casting mold and the initial point of support;
c. measuring the casting velocity of the strand; and
d. providing a multiple point contact support for the freshly cast strand, with the distance W in centimeters between each point of contact longitudinally and transversely of the moving strand being determined by the formula $$W = (42 + 8\ L/Vg)$$

wherein L is the distance in meters from step (b) and Vg is the velocity from step (c) in meters per minute.

2. The method as recited in claim 1, further characterized by a. providing said points of contact longitudinally of the strand path in alternating fashion with adjacent points upstream and downstream of the strand path to provide a lattice-like pattern of support of decreasing width.

* * * * *